US012440775B2

(12) United States Patent
Giernoth

(10) Patent No.: US 12,440,775 B2
(45) Date of Patent: Oct. 14, 2025

(54) DIDACTIC EYE ACTIVATION SYSTEM FOR A DOLL

(71) Applicant: ZAPF CREATION AG, Rodental (DE)

(72) Inventor: Markus Giernoth, Neustadt bei Coburg (DE)

(73) Assignee: MGA ZAPF CREATION GMBH, Rodental (DE)

( * ) Notice: Subject to any disclaimer, the term of this patent is extended or adjusted under 35 U.S.C. 154(b) by 279 days.

(21) Appl. No.: 18/248,082

(22) PCT Filed: Oct. 7, 2021

(86) PCT No.: PCT/EP2021/077690
§ 371 (c)(1),
(2) Date: Apr. 6, 2023

(87) PCT Pub. No.: WO2022/074116
PCT Pub. Date: Apr. 14, 2022

(65) Prior Publication Data

US 2023/0398461 A1 Dec. 14, 2023

(30) Foreign Application Priority Data

Oct. 7, 2020 (BE) ..... 2020/5695

(51) Int. Cl.
*A63H 3/40* (2006.01)
*A63H 3/20* (2006.01)

(52) U.S. Cl.
CPC ..... *A63H 3/40* (2013.01); *A63H 3/20* (2013.01)

(58) Field of Classification Search
CPC ..... A63H 3/40
See application file for complete search history.

(56) References Cited

U.S. PATENT DOCUMENTS 2,144,436 A * 1/1939 Wittmann ..... A63H 3/40 446/345
4,304,063 A 12/1981 Katzman et al.
5,415,579 A 5/1995 Pracas
5,941,750 A 8/1999 Pracas
(Continued)

FOREIGN PATENT DOCUMENTS

DE 2856636 A1 7/1979
DE 69215519 T2 6/1997
(Continued)

OTHER PUBLICATIONS

International Patent Application No. PCT/EP2021/077690; Int'l Written Opinion and Search Report; dated Jan. 10, 2022; 8 pages.

*Primary Examiner* — John A Ricci
(74) *Attorney, Agent, or Firm* — BakerHostetler

(57) ABSTRACT

This invention is a system (10) for actuating eyes (12*a*, 12*b*) of a doll (14). The system has a support structure (16) with a recess portion (18) for receiving a plug-in element (20) along an insertion axis (E). The recess portion extends at least to an intake opening (22) of the doll. A pivot structure (24) pivots about an axis(S) to actuate the eyes, at least depending on a pivoting position of the doll. An eye actuation arrangement (26) pivots about an eye actuation pivot axis (A) to actuate the eyes, depending on a rotational position of the plug-in element in the recess portion.

20 Claims, 5 Drawing Sheets

(56) References Cited

U.S. PATENT DOCUMENTS

| | | | | |
|---|---|---|---|---|
| 6,988,928 | B2 * | 1/2006 | Willett | A63H 3/365 446/337 |
| 7,744,442 | B2 * | 6/2010 | Rettberg | A63H 3/365 446/337 |
| 8,251,769 | B2 * | 8/2012 | Cao | A63H 3/40 446/343 |
| 9,474,981 | B1 * | 10/2016 | Forti | A63H 13/005 |
| 2009/0254554 | A1 * | 10/2009 | Hicken | G06F 16/634 |

FOREIGN PATENT DOCUMENTS

| | | | |
|---|---|---|---|
| DE | 29521744 | U1 | 6/1998 |
| FR | 2042177 | A5 | 2/1971 |
| GB | 2011264 | A | 7/1979 |

* cited by examiner

DIDACTIC EYE ACTIVATION SYSTEM FOR A DOLL

CROSS-REFERENCE TO RELATED APPLICATIONS

The current application is a 371 national stage application of PCT International Application No. PCT/EP2021/077690 filed Oct. 7, 2021, and claims priority to Belgian Application No. BE2020/5695 filed Oct. 7, 2020, the entire disclosures of which are incorporated herein by reference.

TECHNICAL FIELD

The present invention relates to a system for actuating eyes of a doll in different ways.

The present invention furthermore relates to a plug-in element, in particular a dummy, for the system mentioned above.

The present invention furthermore relates to an eye actuation set for a doll having the system mentioned above.

The present invention furthermore relates to a doll head for a doll having the system mentioned above.

The present invention furthermore relates to a doll having the system mentioned above.

BACKGROUND OF THE INVENTION

It has been found that interactive dolls make a positive contribution to the educational development of children owing to the wide variety of influences. By way of example, it is possible for dolls to be able to imbibe liquid from correspondingly formed vessels and thus be able to re-enact the action of drinking from bottles. In the case of already known doll models, this liquid can be used to optionally give rise to watering eyes by applying pressure on the upper body. It is also possible to feed dolls with correspondingly produced mush or with small segments, for example plastic chips. The liquid and/or the mush can be used to expel excretions in a controlled form, as small or large excretions, from the doll. To that end, by way of example, use can be made of a potty, on which the child can place the doll with which they are playing, or a nappy, which can be put on and changed by the child playing with the doll. Movable doll arms and/or legs facilitate the dressing and changing of dolls. The surface of the doll can also be designed soft, in order to give a comfortable feeling to the child playing with the doll. It is also possible for the dolls to be bathed without damaging the other mechanisms. The features mentioned above are to be taken into account in the overall design of the structure of the doll and should be retained.

Children enjoy the feeling of responsibility when they engage with interactive dolls, and therefore a sense of responsibility can be taught. It is therefore necessary to further develop dolls and provide them with more functions, so that these dolls can be reproduced in a more lifelike manner.

DESCRIPTION OF THE INVENTION

Taking this situation as a starting point, it is an object of the present invention to provide a system for actuating eyes of a doll, and in this respect a plug-in element, an eye actuation set, a doll head and a doll which enable wide-ranging eye actuation.

The object of the invention is achieved by the features in the independent main claims. Advantageous embodiments are specified in the dependent claims. Where technically possible, the teachings of the dependent claims can be combined as desired with the teachings of the main and dependent claims.

In particular, the object is achieved accordingly by a system for actuating eyes of a doll, at least comprising:

- a support structure with a recess portion for receiving a plug-in element along an axis of insertion;
- wherein the recess portion is formed to extend at least to an intake opening of the doll;
- a pivot means, which is pivotable relative to the support structure about a pivot means axis in order to actuate, in particular at least indirectly, the eyes at least depending on a pivoting position of the doll;
- an eye actuation arrangement, which is pivotable relative to the support structure about an eye actuation pivot axis in order to actuate, in particular at least indirectly, the eyes at least depending on a rotational position of the plug-in element received in the recess portion.

Advantageous aspects of the claimed invention are explained in the following text, and after that, preferred modified embodiments of the invention are described. Explanations, in particular in relation to advantages and definitions of features, are in principle descriptive and preferred, but not limiting examples. If an explanation is limiting, this is explicitly mentioned.

In other words, it is provided in particular that the system for actuating the eyes of the doll can actuate the eyes in at least two different ways. Within the meaning of the present disclosure, actuating the eyes means that the eyes are opened or closed. A child can therefore operate different mechanisms in order to actuate the eyes of the doll. This teaches the logical thought patterns of the child, and in particular their combinatory capabilities, in a playful manner. It is thus possible for the child, on the basis of an advantageous doll having the system mentioned above, to learn that the pivoting position of the doll is relevant for the actuation of its eyes only when no plug-in element is arranged in the doll, that is to say for example when no dummy is plugged in its mouth. A specific example can provide that the doll can close its eyes when there is no dummy in its mouth and it is moved from a vertical pivoting position to a horizontal pivoting position, in order to imitate a sleeping situation. As soon as the doll, without its dummy, changes position into the vertical pivoting position again, it imitates waking up and opens its eyes. By contrast, it is possible for the actuation of the eyes to be entirely independent of the pivoting position of the doll when it has a plug-in element in its recess portion, for example the dummy in its mouth. Then, the eyes open and close depending on the rotational position of the plug-in element. More specifically, this means that the doll, for example, opens or closes its eyes when the child plays with a dummy in the mouth of the doll and rotates said dummy. Therefore, when a plug-in element has been correspondingly inserted into the recess portion and rotated, the doll can also keep its eyes open in the recumbent state. In particular for children, this system can teach logical thought patterns.

The support structure comprises at least one recess portion. This is suitable for receiving the plug-in element. The plug-in element has a correlating form to the recess portion insofar that it can be inserted into the recess portion, preferably in a correspondingly fitting manner. The support structure can support the pivot means and/or the eye actuation arrangement. As an alternative, the pivot means and/or the eye actuation arrangement can be arranged on the doll head of the doll individually or via a common arrangement.

The plug-in element is inserted at least partially along the axis of insertion. Preferably, the plug-in element has an insertion portion, wherein particularly preferably the main axis of extent of the insertion portion and/or of the recess portion extends substantially coaxially with the axis of insertion. The insertion portion corresponds, for example, to a mouthpiece of a dummy.

The pivot means is pivotable, in particular exclusively, about the pivot means axis. The pivot means is designed to at least indirectly actuate the eyes of the doll at least depending on a pivoting position of the doll. In this respect, at least depending on the pivoting position of the doll means that the eyes can also be actuated on the basis of further features. For example, the rotational position of the plug-in element in conjunction with the pivoting position of the doll can also determine the eye situation. However, it is also possible for exclusively the pivoting position of the doll to determine the eye situation of the doll. The fact that the pivot means at least indirectly actuates the eyes means in particular that a mechanism that actuates the eyes may optionally be present between the pivot means and the eyes. This mechanism can, for example, be the eye actuation arrangement. As an alternative, the pivot means can also directly actuate the eyes.

The pivoting position of the doll in particular has a direct effect on the pivoting position of the pivot means and/or of the support structure. If, therefore, the doll is put down, this change in position, for example, has a direct effect on the pivoting position of the pivot means. In particular, it is provided that changes in position with rotations of the doll have no inhibitive influence on the eye actuation, provided that the pivoting position movement of the doll towards a recumbent position is involved.

In particular, the pivot means pivots about its pivot means axis by virtue of its weight distribution under the influence of gravitational force. Preferably, the pivot means can be in the form of an elongate body with an added cam portion. A specific example is that the pivot means can have approximately the shape of the number one to that end. In particular, in that case the centre of gravity can be at the vertically lower end of the one. The pivot means axis can lie at the upper end. The protruding cam portion can resemble the angle dash of the number one and be designed to interact with a cam holder of the eye actuation arrangement. The cam holder can, for example, be Y-shaped, the cam portion in particular engaging between the two splayed elements of the Y. The two upper dashes of the Y would preferably symbolize that. In particular, the inclination of the Y is unaffected by this.

The system for actuating the eyes of the doll can also have more than one pivot body as pivot means, for example one pivot means per eye, in order to actuate the eyes more precisely and more reliably. In this case, it is possible for the features mentioned in the present disclosure to thus preferably apply to both pivot bodies.

The eye actuation arrangement is pivotable, in particular exclusively, about the eye actuation pivot axis. The eye actuation arrangement is designed to at least indirectly actuate the eyes at least depending on a rotational position of the plug-in element fitted in the recess portion. In this respect, at least depending on the rotational position of the plug-in element fitted in the recess portion means that the eyes can be actuated in combination with other features or without further features or components. However, it is preferred that exclusively the rotational position of the plug-in element fitted in the recess portion actuates the eyes of the doll.

The fact that the eye actuation arrangement at least indirectly actuates the eyes means in particular that a mechanism that actuates the eyes may optionally be present between the eye actuation arrangement and the eyes. This mechanism can, for example, be the pivot means. As an alternative, the eye actuation arrangement can also directly actuate the eyes, for example by means of a magnet arrangement, which magnetically connects the eye actuation arrangement to the eyes.

The pivot means and the eye actuation arrangement can actuate the eyes of the doll optionally independently of one another or only in combination with one another. It is preferably possible for the eyes of the doll to be able to be actuated by the pivot means only in the case of a correspondingly designed eye actuation arrangement. As an alternative or in addition, the eyes of the doll can preferably be actuated by the eye actuation arrangement only in the case of a pivot means that is pivoted in a predefined manner.

A determined rotational position of the plug-in element fitted, that is to say received, in the recess portion can have a similar effect to a plug-in element taken out of the recess portion.

In principle, the wording that the plug-in element is fitted in the recess portion is synonymous with the wording that the plug-in element is received in the recess portion.

If magnets are mentioned within the context of this invention, it is not necessary for them to be formed in one piece. Multiple small magnets can create one magnet that is active overall. To that end, the small magnets can be connected to one another at their opposite poles. Expressed differently, this means that, for example, a north pole of a first magnet can be connected to a south pole of a second magnet, and vice versa.

According to a modified embodiment of the invention, it is provided that the eyes of the doll are at least indirectly actuatable by the pivoting of the pivot means about the pivot means axis, at least depending on the pivoting position of the doll, only when no plug-in element is received in the recess portion. In other words, whether the pivoting position of the doll influences the opening or closing of the eyes depends on the presence of the plug-in element in the recess portion. The rotational position of the plug-in element is preferably irrelevant here. This means preferably that, when a plug-in element that keeps the eyes of the doll open has been fitted in the recess portion, the eyes always remain open, irrespective of whether the doll is sitting with the upper body and head vertical or is recumbent with the upper body and head horizontal. Only and solely by rotating the plug-in element about its axis of rotation, in particular its axis of insertion, can the state of the eyes be changed, for example can the eyes be closed. The same applies for the transfer from closed to open eyes. For a child, in the first instance this can be understood as a contradiction, that the eyes can sometimes be open and sometimes closed preferably in the horizontal pivoting position of the doll. Or else, that the eyes can sometimes be open and sometimes closed preferably in the vertical pivoting position of the doll. It is therefore an educational challenge and thought training for the child to learn that new influences can overwrite previous rules.

According to a modified embodiment of the invention, it is provided that the pivot means is operatively connected to the eye actuation arrangement in order to pivot the latter. This preferably enables a configuration in which the pivoted state of the eye actuation arrangement can dominate the pivoted state of the pivot means. Expressed differently, this means that the pivoted state of the pivot means can be forwarded via the eye actuation arrangement to actuate the eyes when the eye actuation arrangement is free to move in relation to the eyes, or can be arrested by the eye actuation arrangement when the eye actuation arrangement is fixed in relation to the eyes, for example by magnetic fixing of the rotational position. Preferably, the connection between the pivot means and the eye actuation arrangement is a mechanical one. This is a connection option which is simple from a technical perspective. Such connection options are advantageous in particular for children's toys, that is to say also dolls, owing to their durability, since, for example, electric drives are sensitive and thus susceptible to faults on account of their delicate configuration. A possible mechanical connection between the pivot means and the eye actuation arrangement that can preferably be provided is that the pivot means has a cam portion and the eye actuation arrangement has a can holder. These are connection components that are particularly resistant to shocks in mechanical terms. In particular, the cam portion and the cam holder can be operatively connected to one another in such a way that pivoting of the pivot means causes the eye actuation arrangement to pivot.

Preferably, the cam portion can be in the form of a projecting lug, which engages in a cam holder in the form of a Y branch, on the pivot means. The cam portion being pivoted up thus leads to a stop and conjoint pivoting of the upper Y branch of the cam holder. Therefore, the eye actuation arrangement also pivots upwards in the region of the cam holder. By contrast, the cam portion being pivoted down leads to a stop and conjoint pivoting of the lower Y branch of the cam holder. Therefore, the eye actuation arrangement also pivots downwards in the region of the cam holder. This is a simple mechanical connection. If, for example, the doll is bathed, the water will not cause lasting damage to such an operative connection.

According to a modified embodiment of the invention, it is provided that the cam portion is in the form of a bolt body with an axial main axis of extent, wherein preferably the cam portion, along its axial main axis of extent, extends beyond the components forming the cam holder. In particular, the axial main axis of extent of the cam portion in the form of a bolt body extends parallel in relation to the pivot means axis of the pivot means. A bolt body with an axial main axis of extent can be, for example, a cylindrical body. Similarly to the embodiments relating to the cam holder being in the form of a projecting lug, the cam portion in the form of a bolt body engages in the cam holder in the form of a Y branch. It has been found that this configuration of the protruding cam portion means that the functioning capability of the system remains optimally ensured. This is an advantage, for example, when a child pivots the doll in different directions. In that case, the various movement mechanisms in principle should move, and the cam portion and/or the cam holder inadvertently leaving the respective movement position can be avoided. Therefore, a functioning capability of the system with high reliability is ensured by this preferred embodiment.

According to a modified embodiment of the invention, it is provided that the eye actuation arrangement is operatively connected to the eyes in order to actuate them. Preferably, the connection between the eye actuation arrangement and the eyes is a magnetic one. This is a connection option which is simple from a technical perspective. Such connection options are advantageous in particular for children's toys, that is to say also dolls, owing to their durability, since, for example, electric drives are sensitive and thus susceptible to faults on account of their delicate configuration. If the eyes, in the case of a preferred embodiment, are actuated via the eye actuation arrangement alone or via the pivot means in conjunction with the eye actuation arrangement, it is possible for the same pivot mechanism to be used directly at the eyes, with the result that a magnetic pivoting connection acts with particularly low wear. A simple magnetic connection option can preferably be formed in such a way that the eye actuation arrangement has a correspondingly interacting eye actuation magnet for a respective eye magnet at the respective eye. It is thus advantageously provided that each eye has a separate eye magnet. The eye actuation arrangement in particular has two eye actuation magnets, wherein each eye actuation magnet is designed to enter into an operative connection with the respective eye magnet. Preferably, what is thus provided is that the eyes are actuable by changing the distance between the eye actuation magnets and the respective eye magnets. Preferably, at least one eye actuation magnet is arranged in a cam holder of the eye actuation arrangement. Particularly preferably, each of the two eye actuation magnets is arranged in its respective cam holder of the eye actuation arrangement. If the cam portion of the pivot means is connectable to the cam holder of the eye actuation arrangement, this enables a compact structure which has proven to conserve components at the same time.

According to a modified embodiment of the invention, it is provided that the eye actuation arrangement is at least partially in the form of a bow with two bow ends. The fact that the eye actuation arrangement is at least partially in the form of a bow with two bow ends preferably means that the eye actuation arrangement substantially has a bow shape, which, for example, can also have straight portions. The shape of the letter C can preferably and symbolically be considered a bow shape. In that case, the eye actuation pivot axis passes through the bow preferably as a secant, that is to say at two points. In planar geometry and in analysis, a secant denotes a straight line which goes through two points on a curve. The eye actuation arrangement can have a respective eye actuation magnet preferably at a respective bow end, wherein each eye actuation magnet is designed to magnetically interact with an eye magnet arranged at a respective eye. Consequently, the system preferably has a total of two eye actuation magnets, which are configured to interact with a total of two eye magnets of a total of two eyes. In this case, the eyes are actuable by changing the distance between the eye actuation magnets and the respective eye magnets. Preferably, each of the two eye actuation magnets is at the same distance from its respective eye magnet. Since the eye actuation magnets are arranged in particular fixedly on the eye actuation arrangement, the respective distance also remains constant, with the result that both eyes are always open or closed to the same extent.

According to a modified embodiment of the invention, it is provided that the eye actuation arrangement is at least partially in the form of a bow with two bow ends. The fact that the eye actuation arrangement is at least partially in the form of a bow with two bow ends preferably means that the eye actuation arrangement substantially has a bow shape, which, for example, can also have edges. The shape of the letter C can preferably and symbolically be considered a bow shape. In that case, the eye actuation pivot axis passes through the bow preferably as a secant, that is to say at two points. In planar geometry and in analysis, a secant denotes a straight line which goes through two points on a curve. In this case, the eye actuation arrangement has a pivot magnet in the bow between the bow ends, preferably in the bow centre. Said pivot magnet is designed to interact with a plug-in element magnet of the plug-in element, with the result that the eye actuation arrangement is pivotable depending on the rotational position of the plug-in element. This is thus a structurally simple solution for actuation of the eyes by the eye actuation arrangement, for example together with the plug-in element. If the plug-in element is a dummy, a child can thus easily rotate the dummy in the mouth of the doll and the eyes will close and open, in particular in a manner offset by 180 degrees. Upon each rotation of the dummy, the bow centre pivots up or down, with the result that the eye actuation arrangement consequently actuates the eyes.

If the eye actuation arrangement is configured as a bow, its bow centre can be directed in particular towards a mouth of the doll and the two bow ends can preferably each extend to an eye of the doll.

According to a modified embodiment of the invention, it is provided that the eyes, optionally independently of the pivoting position of the doll, are at least indirectly actuable by the pivoting of the eye actuation arrangement about the eye actuation pivot axis at least depending on the rotational position of the plug-in element fitted in the recess portion. Expressed differently, this means that the system can be set in such a way that the eyes are actuable without influencing the pivoting position of the doll. In this case, to actuate the eyes of the doll, it is only relevant that the plug-in element has been inserted into the recess portion in a corresponding position. The optionality of this being done independently of the pivoting position of the doll is preferably an optional feature. This is a suitable configuration to teach the combinatory capabilities of a child.

According to a modified embodiment of the invention, it is provided that the support structure has a first pivot mechanism for the pivotable mounting of the pivot means. Preferably, the pivot means is designed in such a way that the pivoting position of the pivot means depends on the pivoting position of the doll. To that end, part of the first pivot mechanism can be connected to the doll head as part of the support structure. Preferably, however, the first pivot mechanism is not directly connected to the doll head. This is a simple, compact and functionally reliable arrangement of the first pivot mechanism. In addition or as an alternative, it is provided that the support structure has a second pivot mechanism for the pivotable mounting of the eye actuation arrangement. Preferably, the eye actuation arrangement is designed in such a way that the pivoting position of the eye actuation arrangement depends on the rotational position of the plug-in element. To that end, part of the second pivot mechanism can be connected to the doll head as part of the support structure. Preferably, however, the second pivot mechanism is not directly connected to the doll head. This is a simple, compact and functionally reliable arrangement of the second pivot mechanism.

According to a modified embodiment of the invention, it is provided that the pivot means has a mass distribution which is off-centre in relation to the pivot means axis, with the result that a gravitational force acting on the mass distribution determines a pivoting position of the pivot means. To that end, the off-centre mass distribution is effected by a corresponding distribution of the material of the pivot means. This feature enables a cost-effective, simple, compact and functionally reliable off-centre mass distribution. The off-centre mass distribution can preferably also result from a weight which is arranged on the pivot means and always orients the pivot means along the gravitational force acting on the weight. Thus, the pivot means can be produced, for example, from a plastic and the weight from a metallic body, which in particular has a higher density than the plastic. This also enables cost-effective production.

Further preferably, but not limiting, the mass distribution can be in the form of a bolt body with an axial main axis of extent, wherein preferably the mass distribution, along its axial main axis of extent, extends beyond the components forming the cam holder. In particular, the axial main axis of extent of the mass distribution in the form of a bolt body extends parallel in relation to the pivot means axis of the pivot means. A bolt body with an axial main axis of extent can be, for example, a cylindrical body. It has been found that through this configuration of the protruding mass distribution the functioning capability of the system remains optimally ensured. This is an advantage, for example, when a child pivots the doll in different directions. In that case, the various movement mechanisms in principle should move, and the pivot body and/or the cam holder inadvertently leaving the respective movement position can be avoided. Therefore, a functioning capability of the system with high reliability is ensured by this preferred embodiment.

According to a modified embodiment of the invention, it is provided that the recess portion, in particular on the inside, is a hollow-cylindrical recess portion. Hollow-cylindrical recess portion means that the recess portion of the support structure is in the form of a substantially tubular portion. This relates in particular to the inner region of the recess portion. Therefore, the recess portion can simply act as counterbearing for an in particular rounded insertion portion of the plug-in element, with the result that a child playing with the doll can easily guide the plug-in element into and out of the recess portion and rotate the plug-in element easily in the recess portion in order to actuate the eyes. The hollow-cylindrical recess portion can have a circular or an elliptical cross section, preferably at least in certain portions and particularly preferably to the outer intake of the doll. A circular or elliptical insertion portion also applies as rounded insertion portion.

According to a modified embodiment of the invention, it is provided that the recess portion of the support structure is designed to receive a plug-in element with an oversize. This means that certain portions, preferably all, of the inside diameter of the recess portion of the support structure are/is smaller than certain portions, preferably all, of the outside diameter of the plug-in element projecting into the recess portion. In order to enable a child to rotate the plug-in element nevertheless, the inside diameter of the recess portion or the outside diameter of the plug-in element projecting into the recess portion can comprise elastic material, with the result that the plug-in element is not rotationally fixedly secured in the recess portion and can nevertheless be rotated without inadvertently falling out of the recess portion. For children, this facilitates the rotational handling of the plug-in element into the recess portion of the doll in order to actuate its eyes by means of the eye actuation arrangement.

According to a modified embodiment of the invention, it is provided that the support structure has a stop limitation in order to ensure an operative connection between the pivot means and the eye actuation arrangement independently of the pivoting position of the doll. The stop limitation thus ensures that, when the doll is in a horizontal pivoting position, the pivot means does not pivot away so far that the operative connection between the pivot means and the eye actuation arrangement becomes detached. This increases the reliability of the system for actuating the eyes of the doll.

Preferably, but not limiting, the stop limitation is designed in such a way that it limits the pivotability of the pivot means within a pivoting range, for example by virtue of two stop limitation legs arranged at an angle in relation to one another. For this reason, it is preferred for the pivot means to have an outer contour that correlates with the stop limitation. By way of example, the stop limitation legs can be at right angles in relation to one another. If the stop limitation has, for example, the two stop limitation legs mentioned above, the outer contour of the pivot means preferably also has two pivot means stop segments which are substantially at right angles in relation to one another and are each designed to abut a stop limitation leg if the doll is pivoted to a sufficient extent. The pivoting range is thus limited, this also applying to other angles or even if there is only one stop limitation leg. By way of example, a stop limitation leg can extend substantially along the longitudinal axis of the intake opening of the doll. The abutment against this stop limitation leg is then effected in particular transversely to its extent. While an individual stop limitation leg enables a more straightforward structure of the system, two stop limitation legs allow better setting of the pivoting range and thus better control of the eye movement.

By way of example and not limiting, it can be provided that the stop limitation legs can also have different lengths. Thus, in particular, the stop limitation leg that extends substantially along the longitudinal axis of the intake opening of the doll is longer than the stop limitation leg that extends substantially transversely in relation to the longitudinal axis of the intake opening of the doll.

Moreover advantageous is a plug-in element for the aforementioned system comprising at least one aforementioned feature of the system. The plug-in element is in particular a dummy for the doll comprising the aforementioned system.

According to a modified embodiment of the invention, it is provided that the plug-in element comprises an insertion portion for insertion into the recess portion of the support structure along the axis of insertion, wherein preferably the insertion portion is in the form of an ellipsoid. If, for example, the insertion portion and the recess portion have an elliptical form, the insertion portion can be inserted easily into the recess portion. Once the insertion portion is rotated, it is mounted in a form fit in the recess portion until it reaches the next 180 degree position. For children, this facilitates the rotational handling of the plug-in element in the recess portion of the doll in order to actuate its eyes by means of the eye actuation arrangement.

According to a modified embodiment of the invention, it is provided that the plug-in element has a plug-in element magnet, which is arranged in the insertion portion. Therefore, the eye actuation arrangement having a pivot magnet can be pivoted depending on the rotational position of the plug-in element magnet. When the plug-in element magnet preferably has a cylindrical shape with an axis of rotation, the result is a reliable magnet arrangement which at the same time can be mounted easily. In order to optimize the action of the magnets, the cylindrical shape is formed in such a way that the axis of rotation particularly preferably extends orthogonally in relation to the axis of insertion when the plug-in element is received in the recess portion.

According to a modified embodiment of the invention, it is provided that the plug-in element is designed to open the eyes of the doll in a first rotational position and to close them in a second rotational position. To that end, the plug-in element therefore has an axis of rotation which in particular coincides with the axis of insertion of the plug-in element.

Preferably, the rotational positions are spaced apart from one another by 180 degrees. This means, proceeding from the first rotational position of the plug-in element, that after half of a full rotation about its axis of rotation, it is in the second rotational position. After another half of a full rotation about the axis of rotation of the plug-in element, it is back in the first rotational position again. In this case, the direction of rotation is irrelevant, which facilitates the change in rotational position for children. This reduces the degree of difficulty of the system, with the result that its focus can be on the different ways of eye actuation by pivoting the doll or rotating the plug-in element. It is also possible to rotate the plug-in element endlessly in a circle, as a result of which deflecting influences caused by rotational stops of the plug-in element can be avoided. Preferably in the first rotational position of the plug-in element at least one eyes open symbol on the plug-in element is highlighted. Highlighted means visible to a child. Preferably, the plug-in element has two eyes open symbols. In particular, each eyes open symbol is arranged on a shield of the plug-in element so as to be visible to a child. As an alternative or in addition, preferably in the second rotational position of the plug-in element at least one eyes closed position on the plug-in element is highlighted. Highlighted means visible to a child. Preferably, the plug-in element has two eyes closed symbols. In particular, each eyes closed symbol is arranged on a shield of the plug-in element so as to be visible to a child.

The plug-in element can preferably be subdivided into an insertion portion, which is insertable into the doll, and a portion external to the doll, which is not insertable into the doll. Preferably, and not exhaustively, the insertion portion can additionally have a plug-in element magnet and optionally have a magnet fixing means. Also preferably, and not exhaustively, the portion external to the doll can have a shield with a covering element, wherein a grip means can be connected pivotably to the covering element by means of a fixing bolt. The grip means can in particular be in the form of a grip ring.

Moreover advantageous is an eye actuation set for a doll having the aforementioned system, having at least one aforementioned feature of the system.

Moreover advantageous is a doll head for a doll having the aforementioned system, having at least one aforementioned feature of the system.

Moreover advantageous is a doll having the aforementioned system, having at least one aforementioned feature of the system. In this respect, the doll can have any desired form. Thus, it may, for example, be a baby-like toy doll. As an alternative, the doll can also be in the form of an action figure or a plush figure, for example a plush teddy bear. Other forms of dolls are also possible.

In addition, it can be provided that the intake opening of the doll, in particular on the doll head, along its longitudinal axis at least partially has a smaller diameter in a distal portion than in a portion which is proximal in relation to the distal portion. The intake opening can preferably be a mouth of the doll. Using the example of the mouth, this means that the inside diameter of the mouth cavity is larger than the inside diameter of the lips. Therefore, the plug-in element can be inserted into the mouth with greater accuracy, but can be rotated somewhat more loosely, provided the plug-in element is arranged in the mouth cavity. If, for example, the insertion portion and the recess portion have an elliptical form, the insertion portion can be inserted easily into the recess portion. Once the insertion portion is rotated, it is mounted in a form fit in the recess portion until it reaches the next 180 degree position. For children, this facilitates the rotational handling of the plug-in element in the recess portion of the doll in order to actuate its eyes by means of the eye actuation arrangement.

BRIEF DESCRIPTION OF THE DRAWINGS

The invention will be explained in more detail in the following text with reference to the appended drawings on the basis of preferred exemplary embodiments. The word figure is abbreviated to FIG. in the drawings.

In the drawings

DETAILED DESCRIPTION OF THE EXEMPLARY EMBODIMENTS

Figure 1:
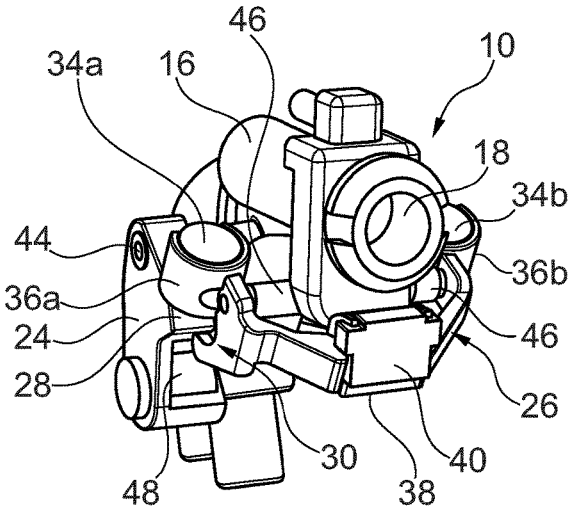
FIG. 1 shows a perspective view of a system for actuating eyes of a doll according to a first preferred exemplary embodiment of the invention.
Figure 2:
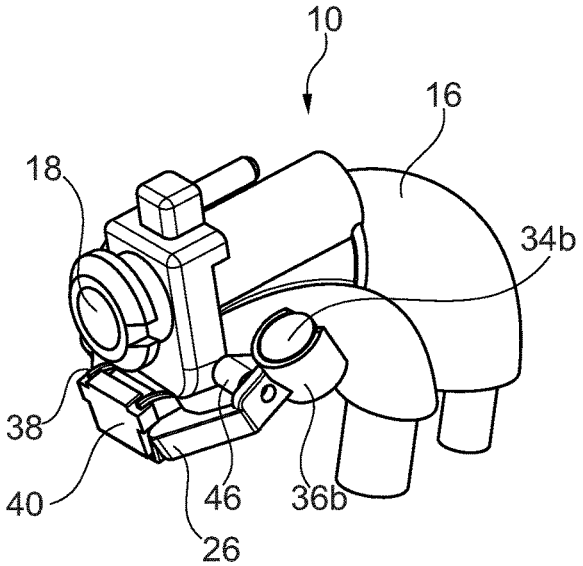
FIG. 2 shows an alternative perspective view of the system for actuating the eyes of the doll according to the exemplary embodiment of FIG. 1.
Figure 3:
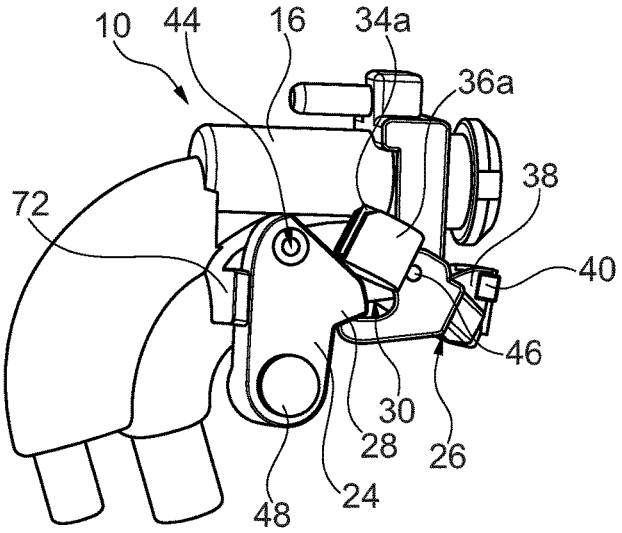
FIG. 3 shows an alternative perspective view of the system for actuating the eyes of the doll according to the exemplary embodiment of FIG. 1.

The described exemplary embodiments are merely examples that can be modified and/or supplemented in a wide variety of ways within the scope of the claims. Any feature that is described for one particular exemplary embodiment can be used on its own or in combination with other features in any desired other exemplary embodiment. Any feature that is described for an exemplary embodiment of one particular claim category can also be used in a corresponding way in an exemplary embodiment of another claim category.

FIGS. 1 to 7 and 10 to 15 show systems 10 for actuating eyes 12*a*, 12*b* of a respective doll 14 in different arrangements, subdivided into three exemplary embodiments.

According to the three exemplary embodiments, a respective system 10 for actuating eyes 12*a*, 12*b* of a doll 14 is provided. In this respect, the respective system has at least one support structure 16. The support structure 16 illustrated is in the form of a separate component. However, the support structure 16 can also partially or completely be a constituent part of a doll head 54. This depends on other features that are illustrated in the figures.

Figure 4:
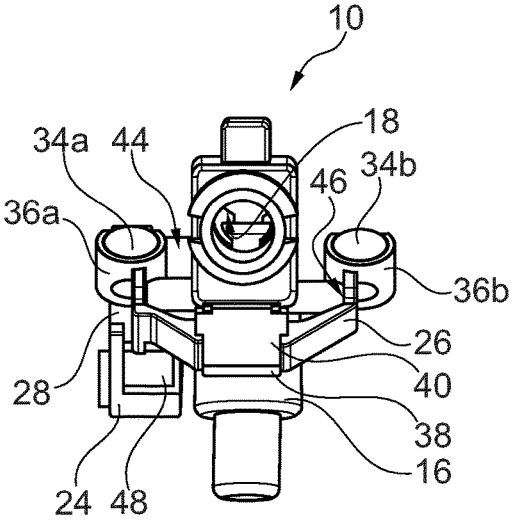
FIG. 4 shows an alternative perspective view of the system for actuating the eyes of the doll according to the exemplary embodiment of FIG. 1.

The support structure 16 has a recess portion 18, which is provided to receive a correlatingly formed plug-in element 20. Preferably FIG. 4 shows that the recess portion 18 is a hollow-cylindrical recess portion 18.

The plug-in element 20 is to be inserted into the recess portion 18 along an axis of insertion E, it also being possible to provide further fitting directions. In this case, the recess portion 18 is formed so as to extend at least to an intake opening 22 of the doll 14.

Each exemplary embodiment comprises a pivot means 24, which is pivotable relative to the support structure 16 about a pivot means axis S in order to actuate the eyes 12*a*, 12*b* indirectly via an eye actuation arrangement 26 depending on a pivoting position of the doll 14.

Furthermore, each exemplary embodiment comprises the eye actuation arrangement 26, which is pivotable relative to the support structure 16 about an eye actuation pivot axis A in order to at least indirectly actuate the eyes 12*a*, 12*b* at least depending on a rotational position of the plug-in element 20 fitted in the recess portion 18, that is to say received by the recess portion 18.

The exemplary embodiments illustrated are configured such that the eyes 12*a*, 12*b* of the doll 14 are actuable by pivoting the pivot means 24 about the pivot means axis S only when no plug-in element 20 is received in the recess portion 18. The pivoting is effected indirectly depending on the pivoting position of the doll 14.

Figure 11:
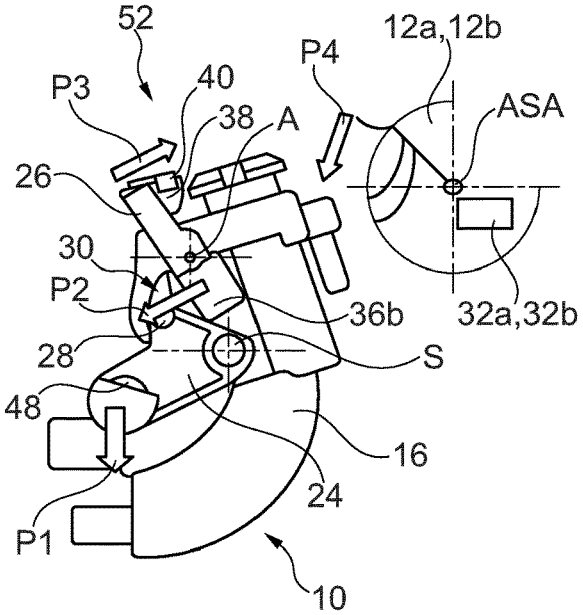
FIG. 11 shows a schematic side view of the system for actuating the eyes of the doll according to the exemplary embodiment of FIG. 10, with the eyes illustrated, wherein the eyes of the doll are closed as a result of an alternative pivoting position of the doll to FIG. 10.

This is realized in particular in that the pivot means 24 is mechanically operatively connected to the eye actuation arrangement 26 in order to pivot it. In this case, the pivot means 24 has a cam portion 28 and the eye actuation arrangement 26 has a cam holder 30. Here, the cam portion 28 and the cam holder 30 are operatively connected to one another in such a way that pivoting of the pivot means 24, for example as a result of gravitational force, causes the eye actuation arrangement 26 to pivot. To that end, the pivot means 24 has a mass distribution that is off-centre in relation to the pivot means axis S, preferably as a result of a weight 48. Therefore, a gravitational force acting on the mass distribution determines a pivoting position of the pivot means 24. This is disclosed with reference to the symbolic illustrations of FIGS. 10 and 11, which illustrate a relative position of an eye 12*a*, 12*b* with respect to the system 10. Thus, FIG. 11 shows the pivoting of the pivot means 24 brought about by the gravitational force acting on the weight 48 by means of a first movement arrow P1. The pivoting movement of the cam portion 28 brings about a pivoting movement of the cam holder 30, which is illustrated symbolically by means of the second movement arrow P2. Consequently, the respective cam holder 30 moves away from a corresponding eye 12*a*, 12*b*. In this case, what is symbolically illustrated is that the position of the system 10 in FIG. 11 has been pivoted by 90 degrees in relation to the position of the system 10 in FIG. 10. The illustrated eye 12*a*, 12*b* is pivoted about the eye pivot axis ASA in this case.

For the sake of completeness, it should be mentioned that the pivoting movement of the cam holder 30 along the second movement arrow P2 in particular brings about a pivoting movement of the bow centre 38 counter to the second movement arrow P2, that is to say along the third movement arrow P3. This preferably takes place directly, in that the second pivot mechanism 46 of the support structure 16 is arranged between the cam holder 30 and the bow centre 38. Consequently, the cam holder 30 pivoting up leads to the bow centre 38 pivoting down, and the cam holder 30 pivoting down leads to the bow centre 38 pivoting up. Conversely, a pivoting movement of the bow centre 38 brings about an opposite pivoting movement of the cam holder 30.

FIGS. 10 to 15 show that the eye actuation arrangement 26 is at least partially in the form of a bow with two bow ends 36*a*, 36*b*. The eye actuation arrangement 26 has a respective eye actuation magnet 34*a*, 34*b* at a respective bow end 36*a*, 36*b*. Preferably, each eye actuation magnet 34*a*, 34*b* is designed to magnetically interact with an eye magnet 32*a*, 32*b* arranged at a respective eye 12*a*, 12*b*, with the result that the eyes 12*a*, 12*b* are actuable by a change in the distance between the eye actuation magnets 34*a*, 34*b* and the respective eye magnets 32*a*, 32*b*. In the exemplary embodiments illustrated, the eyes 12*a*, 12*b* are closed when the eye actuation magnets 34*a*, 34*b* and the eye magnets 32*a*, 32*b* are close enough to one another.

Figure 12:
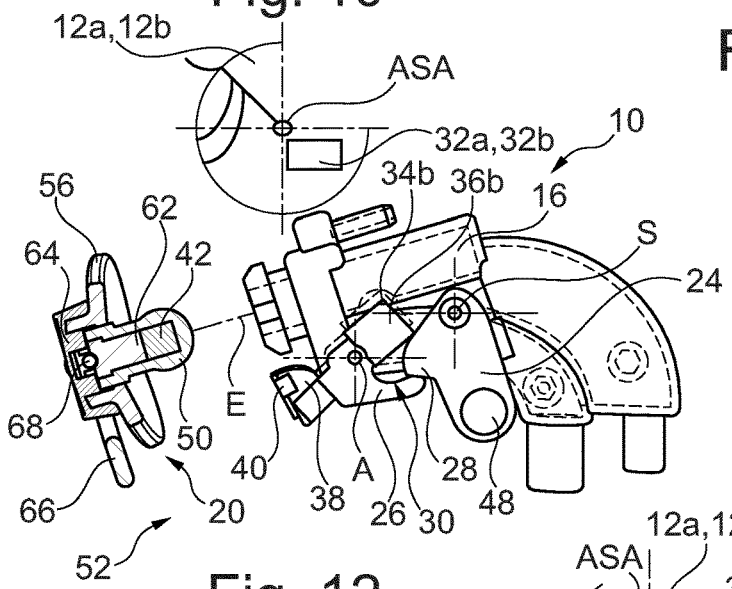
FIG. 12 shows a schematic side view of the system for actuating the eyes of the doll according to the exemplary embodiment of FIG. 10 with the plug-in element and the eyes illustrated, wherein the eyes of the doll are open as a result of a rotational position of the plug-in element.
Figure 13:
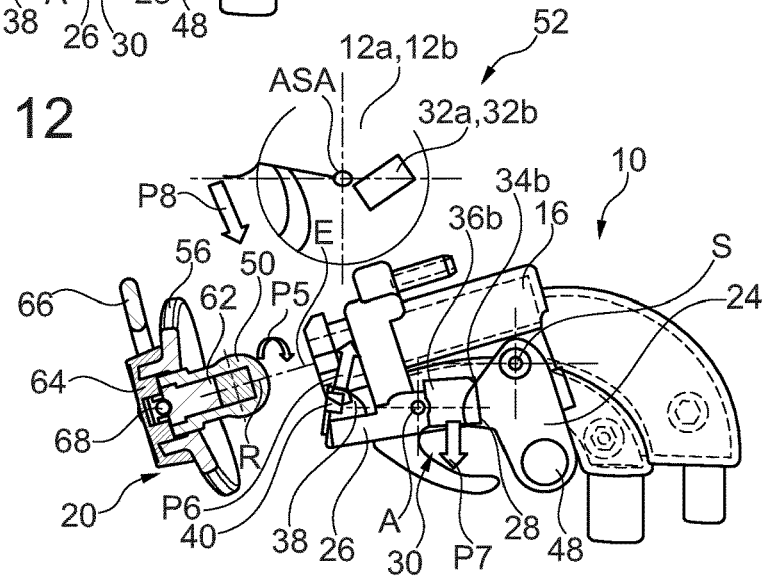
FIG. 13 shows a schematic side view of the system for actuating the eyes of the doll according to the exemplary embodiment of FIG. 10, with the plug-in element and the eyes illustrated, wherein the eyes of the doll are closed as a result of an alternative rotational position of the plug-in element to FIG. 10.

The actuation of the eyes 12*a*, 12*b* by means of the plug-in element 20 will be explained passing from FIG. 12 to FIG. 13. In FIG. 12, the eyes 12*a*, 12*b* are illustrated as open. In FIG. 13, the eyes 12*a*, 12*b* are illustrated symbolically as closed. The plug-in element 20 is designed to open the eyes 12*a*, 12*b* of the doll 14 in a first rotational position and to close them in a second rotational position. The rotational positions are spaced apart from one another by approximately 180 degrees. This is illustrated in FIG. 13 by the movement arrow P5. As can also be readily seen in FIGS. 4 and 5, the eye actuation arrangement 26 is in the form of a bow with two bow ends 36*a*, 36*b*. The eye actuation arrangement 26 has a pivot magnet 40 between the bow ends 36*a*, 36*b*, in the bow centre 38. Said pivot magnet is designed to interact with a plug-in element magnet 42 of the plug-in element 20. Rotating the plug-in element 20 along the movement arrow P5 makes it possible to pivot the eye actuation arrangement 26. While the magnetic polarity of the pivot magnet 40 is not reoriented, the magnetic polarity of the plug-in element magnet 42 that acts on the pivot magnet 40 is changed by rotating the plug-in element 20. The magnetic attraction of the plug-in element magnet 42 to the pivot magnet 40 causes the bow centre 38 to pivot upwards about the eye actuation pivot axis A along the movement arrow P6. At the same time, the bow ends 36*a*, 36*b* pivot downwards about the eye actuation pivot axis A along the movement arrow P7. Pivoting the bow ends 36*a*, 36*b* and the eye actuation magnet 34*a*, 34*b* arranged therein down causes the distance from the eye magnets 32*a*, 32*b* to become larger until the increasing distance makes the magnetic attraction between them weak enough for the magnetic force to no longer be sufficient to keep the eyes 12*a*, 12*b* open, with the result that the eyes 12*a*, 12*b* close along the movement arrow P8. If the plug-in element 20 is rotated again, the plug-in element magnet 42 and the pivot magnet 40 butt against one another, with the result that the eyes open again. The attraction between the plug-in element magnet 42 and the pivot magnet 40 is also lost when the plug-in element 20 is removed from the recess portion 18. Preferably, the off-centre mass distribution of the pivot means 24 acts to set the eye position.

In principle, also possible is an alternative configuration in which the eyes 12*a*, 12*b* remain closed as a result of eye actuation magnets 34*a*, 34*b* interacting with the eye magnets 32*a*, 32*b*, with the result that the eyes open as the distance increases.

Therefore, the eye actuation arrangement 26 is magnetically operatively connected to the eyes 12*a*, 12*b* in order to actuate them. To that end, the eye actuation arrangement 26 has a corresponding eye actuation magnet 34*a*, 34*b* for a respective eye magnet 32*a*, 32*b* at the respective eye 12*a*, 12*b*. Consequently, the eyes 12*a*, 12*b* are actuable by changing the distance between the eye actuation magnets 34*a*, 34*b* and the respective eye magnets 32*a*, 32*b*. A respective eye magnet 32*a*, 32*b* is arranged in a cam holder 30 of the eye actuation arrangement 26. Moving the respective cam holder 30 further away from the corresponding eye 12*a*, 12*b* along the second movement arrow P2 releases the respective eye actuation magnet 34*a*, 34*b* from its corresponding eye magnet 32*a*, 32*b*, with the result that the respective eye 12*a*, 12*b* pivots about an eye pivot axis ASA and moves in the direction of the fourth movement arrow P4, so that the corresponding eye 12*a*, 12*b* closes. Were the respective eye actuation magnet 34*a*, 34*b* to come closer to its corresponding eye magnet 32*a*, 32*b* again, the respective eye 12*a*, 12*b* would open.

According to FIGS. 12 and 13, it is disclosed that the eyes 12*a*, 12*b* are at least indirectly actuable by the pivoting of the eye actuation arrangement 26 about the eye actuation pivot axis A at least depending on the rotational position of the plug-in element fitted in the recess portion 18. This is optionally done independently of the pivoting position of the doll 14. In this respect, optionally means preferably that the eyes 12*a*, 12*b* are actuable either depending on the pivoting position of the doll 14 or depending on the pivoting of the eye actuation arrangement 26 about the eye actuation pivot axis A. It is therefore not intended for the system 10 to be able to perform just one option, but that both options are possible. Consequently, a child playing with the doll 14 can deliberately select one of the two options.

FIGS. 10 to 13 partially depict both eyes 12*a*, 12*b* and both eye magnets 32*a*, 32*b*, whereas, for example, only one bow end 36*b* or only one eye actuation magnet 34*b* is depicted. This situation should not be interpreted narrowly, since it is a symbolized exemplary embodiment. Accordingly, unless mentioned otherwise, for all the figures it is preferred that a separate component is present for each half of the face of the doll head 54. By way of example, however, only a single pivot means 24 can be present for both eyes 12*a*, 12*b* together.

Figure 5:
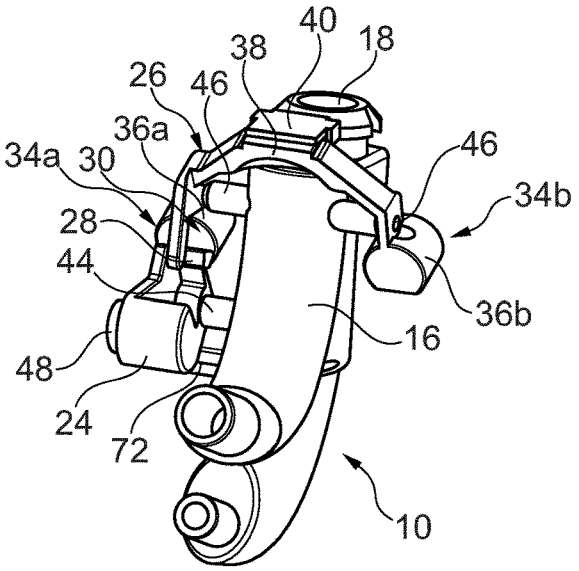
FIG. 5 shows an alternative perspective view of the system for actuating the eyes of the doll according to the exemplary embodiment of FIG. 1.
Figure 6:
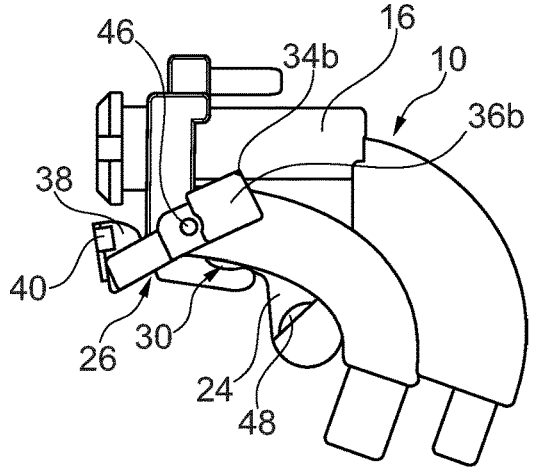
FIG. 6 shows an alternative perspective view of the system for actuating the eyes of the doll according to the exemplary embodiment of FIG. 1.
Figure 7:
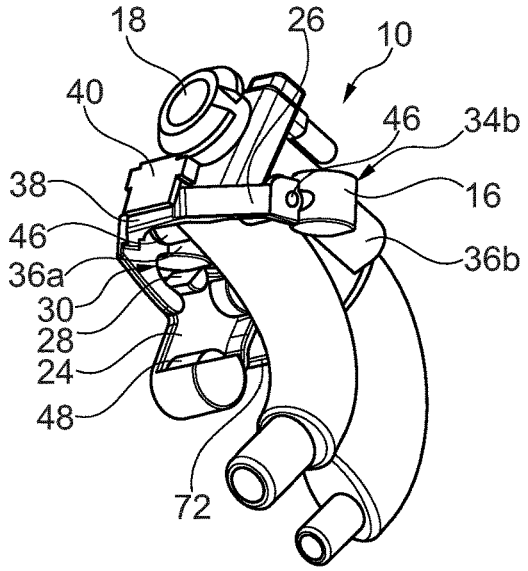
FIG. 7 shows an alternative perspective view of the system for actuating the eyes of the doll according to the exemplary embodiment of FIG. 1.

As shown in FIG. 5, it is provided that the support structure 16 has a first pivot mechanism 44 for the pivotable mounting of the pivot means 24. As illustrated symbolically in FIGS. 10 and 11, the pivoting position of the pivot means 24 depends on the pivoting position of the doll 14.

Figure 14:
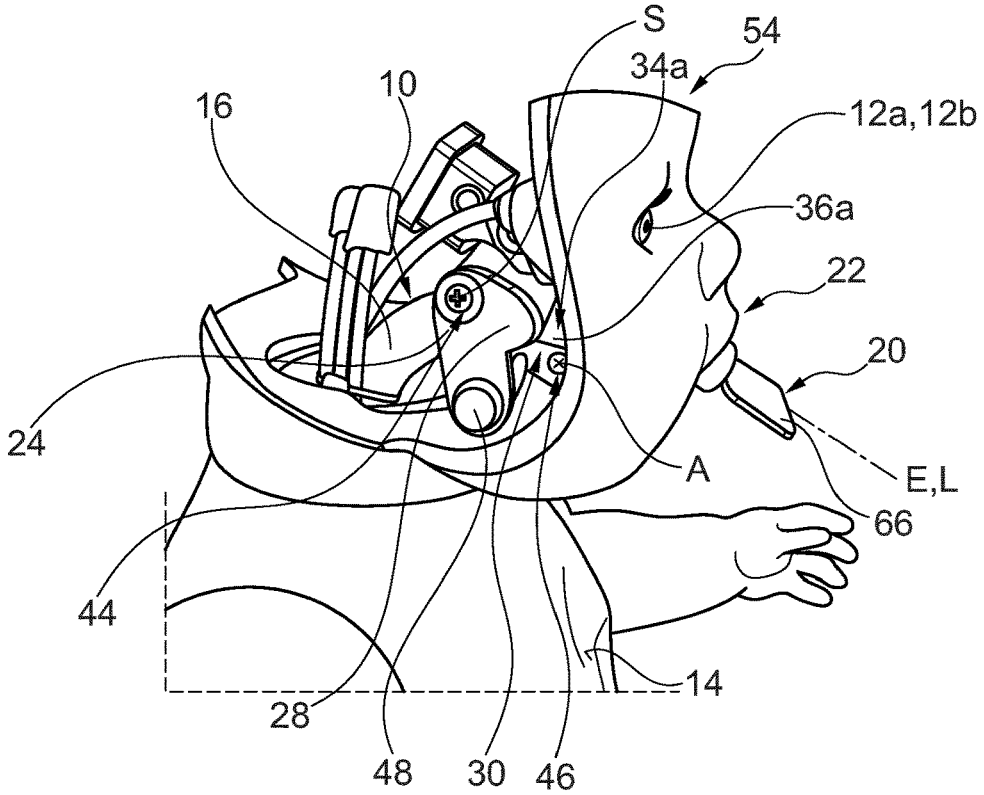
FIG. 14 shows a perspective view of a system, mounted in a doll head of a doll, for actuating eyes of the doll according to a third preferred exemplary embodiment of the invention, wherein the eyes of the doll are open as a result of a rotational position of the plug-in element.
Figure 15:
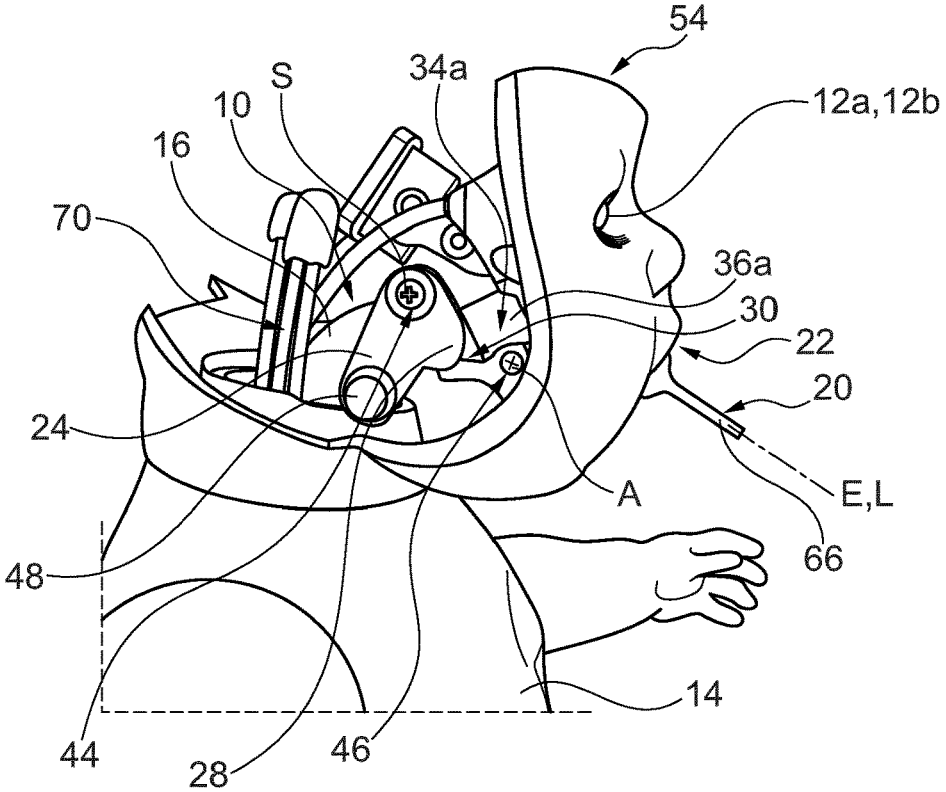
FIG. 15 shows the perspective view of the system, mounted in the doll head of the doll, for actuating the eyes of the doll according to the exemplary embodiment of FIG. 14, wherein the eyes of the doll are closed as a result of an alternative rotational position of the plug-in element.

As also shown in FIG. 5, it is provided that the support structure 16 illustrated has a second pivot mechanism 46 for the pivotable mounting of the eye actuation arrangement 26. In terms of the second pivot mechanism 46, the pivoting position of the eye actuation arrangement 26 depends on the rotational position of the plug-in element 20. In the case of FIGS. 12 and 14, the rotational position of the plug-in element 20 is such that the eyes 12*a*, 12*b* are open. In the case of FIGS. 13 and 15, the rotational position of the plug-in element 20 changes in such a way that the eyes 12*a*, 12*b* are closed.

As illustrated symbolically in FIGS. 12 and 13, it can be provided that the recess portion 18 of the support structure 16 is designed to receive a plug-in element 20 with an oversize. In this case, the plug-in element 20 does not need to have the oversize throughout, but, for example, it can have the oversize in the region of the largest diameter in the case, for example, of an insertion portion 50 which is in the form of an ellipsoid.

Preferably, and independently of that, the recess portion 18 has an elastic inside diameter region, with the result that an insertion portion 50 inserted in the recess portion 18 is elastically retained. Consequently, the plug-in element 20 is secured against falling out of the recess portion 18 while it is being rotated.

In particular according to FIG. 5 of the first exemplary embodiment, it is provided that the support structure 16 has a stop limitation 72, in order to ensure an operative connection between the pivot means 24 and the eye actuation arrangement 26 independently of the pivoting position of the doll 14. If, for example, a cam portion 28 is arranged in a corresponding cam holder 30, the cam portion 28 could slide out of the cam holder 30 when the doll 14 is inclined to a relatively great extent. When pivoting back, the cam holder 30 could possibly pivot back faster than the cam portion 28 does, so that they are not operatively connected. The stop limitation 72 makes it possible to reduce this risk.

Figure 8:
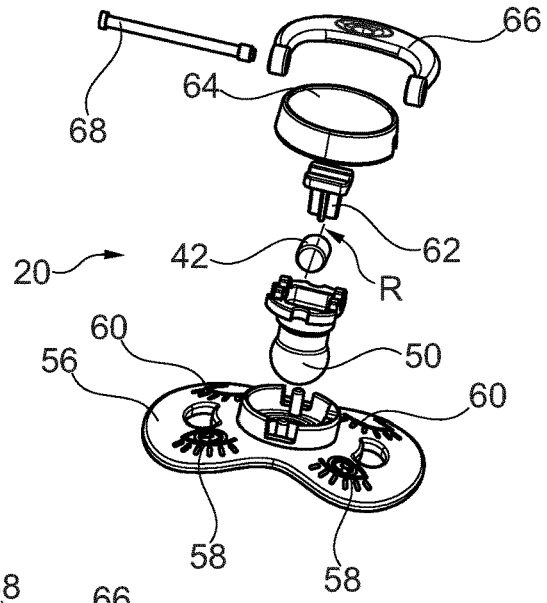
FIG. 8 shows a perspective exploded view of a plug-in element in the form of a dummy, according to a first preferred exemplary embodiment of the invention for the system for actuating the eyes of the doll according to FIG. 1.
Figure 9:
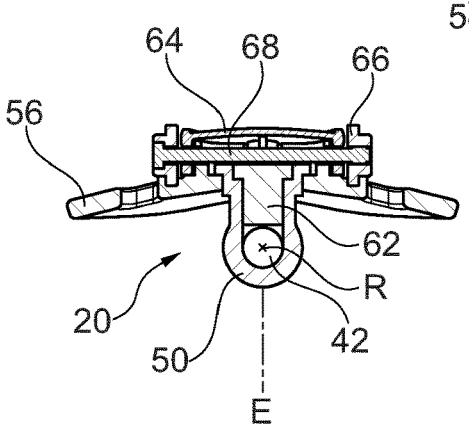
FIG. 9 shows a cross-sectional view of the plug-in element according to the exemplary embodiment of FIG. 8.
Figure 10:
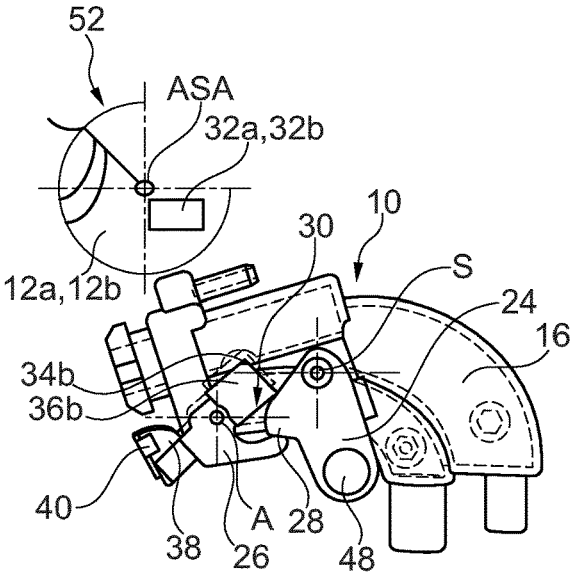
FIG. 10 shows a schematic side view of a system for actuating eyes of a doll according to a second preferred exemplary embodiment of the invention, with the eyes illustrated, wherein the eyes of the doll are open as a result of a pivoting position of the doll.

In particular FIGS. 8 and 9 show the plug-in element 20, in the form of a dummy, for the illustrated system 10 for actuating the eyes 12*a*, 12*b* of the doll 14 in a preferred exemplary embodiment.

This plug-in element 20 has an insertion portion 50 for insertion into the recess portion 18 of the support structure 16. The plug-in element 20 is inserted into the recess portion 18 along the axis of insertion E.

The plug-in element 20 also comprises a plug-in element magnet 42. The plug-in element magnet 42 is arranged in the insertion portion 50, with the plug-in element magnet 42, which can be seen in particular in FIG. 8, having a cylindrical shape with an axis of rotation R. Furthermore shown in FIGS. 8 and 9 is that the cylindrical shape is formed such that the axis of rotation R extends orthogonally in relation to the axis of insertion E when the plug-in element 20 is received in the recess portion 18.

The plug-in element magnet 42 is fixed in the insertion portion 50 by a magnet fixing means 62, with other fixing options that are not illustrated also being possible, for example injection moulding processes or other fixing methods. In the exemplary embodiment illustrated, the insertion portion 50 has, for example, a bore, the plug-in element magnet 42 being arranged on the inner stop of said bore. More preferably still, the insertion portion 50 and the magnet fixing means 62 can have an at least partially, preferably completely, planar, that is to say step-free, form in relation to one another at the end remote from the inner stop. In this case, the insertion portion 50 extends through a shield 56. To that end, the shield 56 has an opening. The insertion portion 50 can preferably have a bearing flange, which prevents the insertion portion 50 from sliding through the shield 56. The shield 56 can have a covering element 64 on the side remote from the doll 14. Said covering element can preferably be designed to secure the insertion portion 50 and components fitted therein. The covering element 64 can also have a grip means 66, which in particular is in the form of a grip ring. The grip means 66 can preferably be used to distinguish the rotational position of the plug-in element 20. The grip means 66 is preferably connected to the covering element 64 by a fixing bolt 68. The grip means 66 can be pivotably connected to the covering element 64 by the fixing bolt 68. The fixing bolt 68 can act as preferably direct counterbearing for the magnet fixing means 62 and the insertion portion 50.

Preferably, the insertion portion 50 is in the form of an ellipsoid. It is can also preferably be provided that the intake opening 22 is in the form of a mouth of the doll 14. In this case, the intake opening 22 along its longitudinal axis L at least partially has a smaller diameter in a distal portion than in a portion which is proximal in relation to the distal portion. In the present example, this can be applied to the mouth of the doll 14. The mouth thus has lips which form a substantially elliptical opening. The mouth interior has a larger inside diameter. In conjunction with the insertion portion 50 in the form of an ellipsoid, this means that the ellipsoid can be inserted into the elliptical opening of the lips. If the plug-in element 20 is rotated between 0 and 180 degrees, the plug-in element 20 is secured against falling out of the mouth while being rotated. In particular for small children, this facilitates handling of the plug-in element 20.

What can be seen in FIG. 8 is that, in the first rotational position of the plug-in element 20, preferably two eyes open symbols 58 on the plug-in element 20, specifically on the shield 56 of the plug-in element 20, are highlighted. It can also be seen that, in the second rotational position of the plug-in element 20, two eyes closed symbols 60 on the plug-in element 20, specifically on the shield 56 of the plug-in element 20, are highlighted. While in the case of a real dummy for a human baby, the shield 56 serves as protection against the dummy being swallowed, the shield 56 serves as a display platform for the rotational position of the plug-in element 20.

The plug-in element 20 in the form of a dummy, the system 10 for actuating the eyes 12*a*, 12*b* of the doll 14, and optionally the eyes 12*a*, 12*b* can be combined in the form of an eye actuation set 52. Therefore, FIGS. 12 and 13 show a first eye actuation set 52 and FIGS. 14 and 15 show a second eye actuation set 52. The essential difference between these eye actuation sets 52 is that the second eye actuation set 52 does not have a stop limitation 72, with the result that its pivot means 24 is not secured and its cam portion 28 can become detached from the cam holder 30. By contrast, the cam portion 28 of the pivot means 24 in the first eye actuation set 52 is secured in the cam holder 30 by the stop limitation 72.

The doll head 54 is a toy doll head. It has the eye actuation set 52 that was mentioned above for the doll 14.

Furthermore, and independently of the other features presented, the system 10 for actuating the eyes 12*a*, 12*b* of the doll 14 has fluid lines 70. These can, for example, be incorporated in the system 10 or even the eye actuation set 52 in such a way that the fluid lines 70 preferably extend to the eyes 12*a*, 12*b*, so that an artificial tear liquid can be fed to the latter. In addition or as an alternative, the fluid lines 70 can be connected to the support structure 16 in such a way that the recess portion 18 is designed to receive liquid, in particular water, and/or foodstuffs, in particular mush. These can be conveyed into the interior region of the doll 14 via the fluid lines 70.

Although FIGS. 10 to 15 disclose only one eye 12*a*, 12*b*, one eye magnet 32*a*, 32*b*, one eye actuation magnet 34*a*, 34*b* and one bow end 36*a*, 36*b*, this is in particular due only to the fact that the view is from the side. Preferably, the system 10 has the same laterally discernible features also on the half of the face of the doll 14 that is behind. In addition, the doll 14 can also have two pivot means 24. Optionally, as shown in FIGS. 1 to 7, it may also be provided that the doll 14 has only a single pivot means 24.

Figure 16:
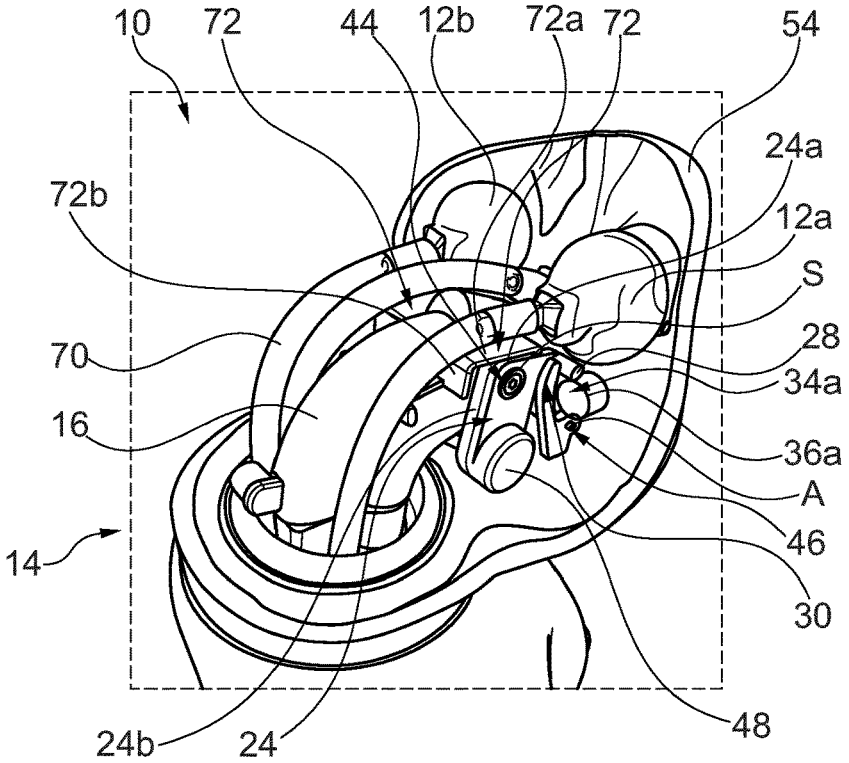
FIG. 16 shows a perspective view of a system, mounted in a doll head of a doll, for actuating eyes of the doll according to a fourth preferred exemplary embodiment of the invention, wherein the eyes of the doll are open as a result of a rotational position of the plug-in element.
Figure 17:
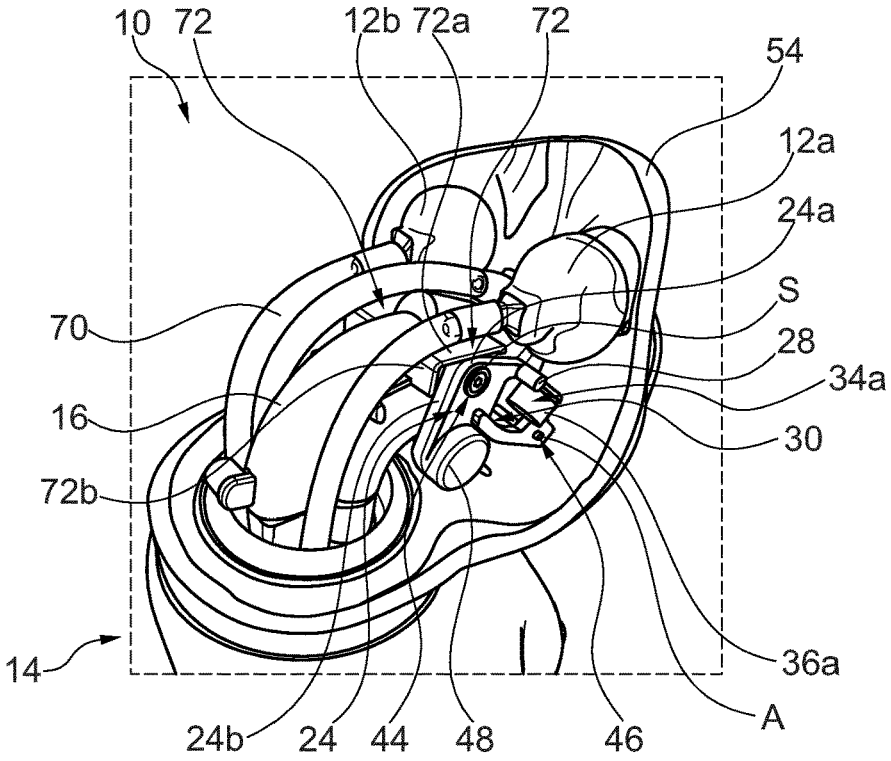
FIG. 17 shows the perspective view of the system, mounted in the doll head of the doll, for actuating the eyes of the doll according to the exemplary embodiment of FIG. 16, wherein the eyes of the doll are closed as a result of an alternative rotational position of the plug-in element.

Lastly, FIGS. 16 and 17 disclose a fourth exemplary embodiment of the system 10 for actuating eyes 12*a*, 12*b* of a doll 14, wherein the eyes 12*a*, 12*b* of the doll 14 are open owing to a rotational position of the plug-in element 20 in FIG. 16, and closed owing to a different rotational position of the plug-in element 20 in FIG. 17. An exemplary difference of this exemplary embodiment over the other exemplary embodiments is that the cam portion 28 is in the form of a bolt body with an axial main axis of extent, wherein the cam portion 28 extends beyond the components forming the cam holder 30 along its axial main axis of extent. In other words, this means that the bolt body protrudes axially from the cam holder 30 and is not on the verge of falling out of it. In particular, the axial main axis of extent of the cam portion 28 in the form of a bolt body extends parallel in relation to the pivot means axis S of the pivot means 24. A bolt body with an axial main axis of extent can be, for example, a cylindrical body, as can be seen in FIGS. 16 and 17. Similarly to the statements relating to the cam holder being in the form of a projecting lug, as illustrated by way of example in FIGS. 14 and 15, the cam portion 28 in the form of a bolt body engages in the cam holder 30 in the form of a Y branch. It has been found that this configuration of the protruding cam portion 28 means that the functioning capability of the system 10 remains optimally ensured. This is an advantage, for example, when a child pivots the doll 14 into different positions. In that case, the various movement mechanisms in principle should move, and the cam portion 28 and/or the cam holder 30 inadvertently falling out of the respective movement position can be avoided. Therefore, a functioning capability of the system 10 with high reliability is ensured by this preferred exemplary embodiment.

Furthermore, according to FIGS. 16 and 17, it is preferred, but not limiting, that the weight 48 serving as mass distribution can be in the form of a bolt body with an axial main axis of extent, wherein the weight 48 extends, and thus projects, beyond the components forming the cam holder 30 along its axial main axis of extent. In particular, the axial main axis of extent of the mass distribution in the form of a bolt body extends parallel in relation to the pivot means axis S of the pivot means 24. A bolt body with an axial main axis of extent can be, for example, a cylindrical body. It has been found that this configuration of the protruding mass distribution that the functioning capability of the system 10 remains optimally ensured. This is an advantage, for example, when a child pivots the doll 14 into different positions. In that case, the various movement mechanisms in principle should move, and the pivot body 24 and/or the cam holder 30 inadvertently falling out of the respective movement position can be avoided. Therefore, a functioning capability of the system 10 with high reliability is ensured by this preferred exemplary embodiment.

Lastly, according to FIGS. 16 and 17, it is preferred for the stop limitation 72 to be designed in such a way that it limits the pivotability of the pivot means 24 within a pivoting range, for example by virtue of two stop limitation legs 72*a*, 72*b* arranged at an angle in relation to one another. For this reason, it is preferred for the pivot means 24 to have an outer contour that correlates with the stop limitation 72. By way of example, the stop limitation legs 72*a*, 72*b* can be at right angles to one another, as illustrated in FIGS. 16 and 17. Correlatively, the outer contour of the pivot means 24 preferably also has two pivot means stop segments 24*a*, 24*b*, which are substantially at right angles to one another and are each designed to abut a stop limitation leg 72*a*, 72*b* in the event of sufficient pivoting of the doll 14. The pivoting range is thus limited, this also being applicable to other angular positions of the stop limitation leg 72*a*, 72*b*, or even if there is only one stop limitation leg 72*a*. By way of example, a stop limitation leg 72*a* can extend substantially along the longitudinal axis L of the intake opening 22 of the doll 14. Although this is the case in FIGS. 16 and 17, it must be recognized with acknowledgement of the overall disclosure, since the intake opening 22 of the doll 14 would be the mouth and thus cannot be seen in the rear view. The abutment against the stop limitation leg 72*a*, which extends substantially along the longitudinal axis L of the intake opening 22 of the doll 14, is then effected in particular transversely in relation to its extent. While an individual stop limitation leg 72*a* enables a more straightforward structure of the system 10, two stop limitation legs 72*a*, 72*b* allow better setting of the pivoting range and thus better control of the eye movement.

By way of example and not limiting, FIGS. 16 and 17 show that the stop limitation legs 72*a*, 72*b* can also have different lengths. Thus, the stop limitation leg 72*a* that extends substantially along the longitudinal axis L of the intake opening 22 of the doll 14 is longer than the stop limitation leg 72*b* that extends substantially transversely in relation to the longitudinal axis L of the intake opening 22 of the doll 14.

The system 10 of the doll 14 of FIGS. 16 and 17 also has two pivot means 24 and correspondingly formed components, in particular pivot mechanisms 44, 46. This improves the actuation precision of the eye movements.

It should be noted that the features of the system 10 of the doll 14 of FIGS. 16 and 17 are also applicable to the other exemplary embodiments as additions or alternatives.

The exemplary embodiments are in particular in the form of schematic basic illustrations.

LIST OF REFERENCE SIGNS

10 System
12*a*, 12*b* Eyes
14 Doll
16 Support structure
18 Recess portion
20 Plug-in element
22 Intake opening
24 Pivot means
24*a* First pivot means stop segment
24*b* Second pivot means stop segment
26 Eye actuation arrangement
28 Cam portion
30 Cam holder
32*a*, 32*b* Eye magnets
34*a*, 34*b* Eye actuation magnets
36*a*, 36*b* Bow ends
38 Bow centre
40 Pivot magnet
42 Plug-in element magnet
44 First pivot mechanism of the support structure
46 Second pivot mechanism of the support structure
48 Weight
50 Insertion portion
52 Eye actuation set
54 Doll head
56 Shield
58 Eyes open symbol
60 Eyes closed symbol
62 Magnet fixing means
64 Covering element
66 Grip means
68 Fixing bolt
70 Fluid lines
72 Stop limitation
72*a* First stop limitation leg
72*b* Second stop limitation leg
S Pivot means axis of the pivot means
A Eye actuation pivot axis of the eye actuation arrangement
L Longitudinal axis of the intake opening of the doll
E Axis of insertion of the plug-in element
R Axis of rotation of the plug-in element
ASA Eye pivot axis
P1-P8 Movement arrows

The invention claimed is:

1. A system for actuating eyes of a doll, comprising:
a support structure with a recess portion for receiving a plug-in element along an axis of insertion;
wherein the recess portion is formed so as to extend at least to an intake opening of the doll;
a pivot means, which is pivotable relative to the support structure about a pivot means axis in order to actuate the eyes at least depending on a pivoting position of the doll; and
an eye actuation arrangement, which is pivotable relative to the support structure about an eye actuation pivot axis in order to actuate the eyes at least depending on a rotational position of the plug-in element received in the recess portion.

2. The system according to claim 1, wherein:
the eyes of the doll are at least indirectly actuatable by a pivoting of the pivot means about the pivot means axis, at least depending on the pivoting position of the doll, when the plug-in element is not received in the recess portion.

3. The system according to claim 2, wherein:
the pivot means is operatively connected to the eye actuation arrangement in order to pivot the eye actuation arrangement, wherein the pivot means comprises a cam portion and the eye actuation arrangement comprises a cam holder, wherein the cam portion and the cam holder are operatively connected to one another in such a way that a pivoting of the pivot means causes the eye actuation arrangement to pivot.

4. The system according to claim 3, wherein:
the cam portion comprises a bolt body with an axial main axis of extent, wherein the cam portion, along the axial main axis of extent, extends beyond components forming the cam holder.

5. The system according to claim 3, wherein:
the eye actuation arrangement is operatively connected to the eyes in order to actuate the eyes, wherein the eye actuation arrangement comprises a corresponding eye actuation magnet for a respective eye magnet at a respective eye of the eyes, wherein the eyes are actuatable by a change in a distance between the eye actuation magnets and the respective eye magnets; and
wherein at least one eye actuation magnet is arranged in the cam holder of the eye actuation arrangement.

6. The system according to claim 5, wherein:
the eye actuation arrangement is at least partially in a form of a bow with two bow ends;
wherein the eye actuation arrangement comprises a respective eye actuation magnet at each respective bow end, wherein each eye actuation magnet is configured to magnetically interact with an eye magnet arranged at a respective eye of the eyes, with the result that the eyes are actuatable by a change in a distance between the eye actuation magnets and the respective eye magnets.

7. The system according to claim 5, wherein:

the eye actuation arrangement is at least partially in a form of a bow with two bow ends;

wherein the eye actuation arrangement comprises a pivot magnet between the bow ends which is configured to interact with a plug-in element magnet of the plug-in element such that the eye actuation arrangement is pivotable depending on the rotational position of the plug-in element.

8. The system according to claim 3, wherein the pivot means has a mass distribution which is off-centre in relation to the pivot means axis, with a result that a gravitational force acting on the mass distribution determines a pivoting position of the pivot means, wherein the mass distribution is in a form of a bolt body with an axial main axis of extent, wherein the mass distribution, along the axial main axis of extent, extends beyond components forming the cam holder.

9. The system according to claim 1, wherein:

the eyes, optionally independently of the pivoting position of the doll, are at least indirectly actuatable by a pivoting of the eye actuation arrangement about the eye actuation pivot axis at least depending on the rotational position of the plug-in element fitted in the recess portion.

10. The system according to claim 1, wherein:

the support structure comprises a first pivot mechanism for a pivotable mounting of the pivot means, wherein the pivot means is designed in such a way that a pivoting position of the pivot means depends on the pivoting position of the doll, or wherein the support structure comprises a second pivot mechanism for the pivotable mounting of the eye actuation arrangement, wherein the eye actuation arrangement is designed in such a way that the pivoting position of the eye actuation arrangement depends on the pivoting position of the plug-in element.

11. The system according to claim 1, wherein:

the recess portion comprises a hollow-cylindrical recess portion.

12. The system of a doll according to claim 1, wherein:

the recess portion of the support structure is designed to receive the plug-in element with an oversize.

13. The system according to claim 1, wherein:

the support structure comprises a stop limitation in order to ensure an operative connection between the pivot means and the eye actuation arrangement independently of the pivoting position of the doll, wherein the stop limitation is designed in such a way that the stop limitation limits a pivotability of the pivot means within a pivoting range.

14. The system of claim 13, wherein:

the plug-in element is designed to open the eyes of the doll in a first rotational position and to close the eyes in a second rotational position;

wherein the first rotational position and the second rotational position are spaced apart from one another by 180 degrees; or wherein, in the first rotational position of the plug-in element, at least one eyes open symbol on the plug-in element is highlighted; or wherein, in the second rotational position of the plug-in element, at least one eyes closed symbol on the plug-in element is highlighted.

15. The system according to claim 1, wherein the plug-in element is designed for insertion along the axis of insertion into the recess portion of the support structure.

16. The system according to claim 15, wherein:

the plug-in element comprises an insertion portion for insertion into the recess portion of the support structure along the axis of insertion, wherein the insertion portion is in a form of an ellipsoid.

17. The system of claim 16, wherein:

the plug-in element comprises a plug-in element magnet arranged in the insertion portion, wherein the plug-in element magnet is a cylindrical shape with an axis of rotation such that the axis of rotation extends orthogonally in relation to the axis of insertion when the plug-in element is received in the recess portion.

18. A doll head, in particular a toy doll head, having the system for actuating eyes of a doll according to claim 1.

19. A doll, in particular a toy doll, having a doll head according to claim 18.

20. The doll according to claim 19, wherein the intake opening comprises a mouth of the doll, and wherein the mouth at least partially has a smaller cross section in a distal portion than in a portion which is proximal in relation to the distal portion.

* * * * *